US009032657B1

(12) United States Patent
Walker

(10) Patent No.: US 9,032,657 B1
(45) Date of Patent: May 19, 2015

(54) FINGERPRINT RECOGNITION SAFETY SYSTEMS

(71) Applicant: Kenneth Walker, Lake Park, FL (US)

(72) Inventor: Kenneth Walker, Lake Park, FL (US)

( * ) Notice: Subject to any disclaimer, the term of this patent is extended or adjusted under 35 U.S.C. 154(b) by 0 days.

(21) Appl. No.: 14/046,929

(22) Filed: Oct. 5, 2013

Related U.S. Application Data

(60) Provisional application No. 61/760,311, filed on Feb. 4, 2013.

(51) Int. Cl.
*F41A 17/06* (2006.01)

(52) U.S. Cl.
CPC ..... *F41A 17/066* (2013.01)

(58) Field of Classification Search
CPC ..... F41A 17/06; F41A 17/063
USPC ..... 42/70.01, 70.02, 70.03, 70.04, 70.05, 42/70.06, 70.08, 70.11
See application file for complete search history.

(56) References Cited

U.S. PATENT DOCUMENTS

| | | | | |
|---|---|---|---|---|
| 5,459,957 | A * | 10/1995 | Winer | 42/70.11 |
| 5,579,909 | A | 12/1996 | Deal | |
| 5,603,179 | A | 2/1997 | Adams | |
| 5,915,936 | A * | 6/1999 | Brentzel | 42/70.11 |
| 6,185,852 | B1 * | 2/2001 | Whalen et al. | 42/70.11 |
| 6,230,946 | B1 | 5/2001 | Vor Keller | |
| 6,421,943 | B1 * | 7/2002 | Caulfield et al. | 42/70.11 |
| 6,499,243 | B1 * | 12/2002 | Herzog | 42/70.07 |
| 6,711,843 | B2 | 3/2004 | Klebes | |
| 6,823,621 | B2 * | 11/2004 | Gotfried | 42/70.06 |
| 6,874,265 | B1 | 4/2005 | Pathak | |
| 8,104,313 | B2 | 1/2012 | Wolfe | |
| 2004/0031180 | A1 * | 2/2004 | Ivanov | 42/70.11 |
| 2013/0019510 | A1 * | 1/2013 | Kemmerer et al. | 42/1.01 |
| 2014/0202058 | A1 * | 7/2014 | Zhou | 42/70.11 |

* cited by examiner

*Primary Examiner* — Bret Hayes

(74) *Attorney, Agent, or Firm* — RG Patent Consulting, LLC; Rachel Gilboy

(57) ABSTRACT

A universal fingerprint recognition system for firearms that greatly reduces misuse and accidental discharge of a firearm. The fingerprint recognition assembly is completely embedded within the firearm to prevent tampering. A chip embedded in the trigger scans the firearm owner's fingerprint, and when recognized releases a safety pin, allowing the trigger to be pulled. A charging port embedded in the firearm's grip allows a USB-type connector to be attached and charge the battery chip in the CPU.

20 Claims, 5 Drawing Sheets

FINGERPRINT RECOGNITION SAFETY SYSTEMS

CROSS-REFERENCE TO RELATED APPLICATION

The present application is related to and claims priority from prior provisional application Ser. No. 61/760,311, filed Feb. 4, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of firearm safety and more specifically relates to a fingerprint recognition safety system for use with firearms.

2. Description of the Related Art

Many individuals in modern society own and shoot firearms. A firearm is a portable gun, being a barreled weapon that launches one or more projectiles often defined by the action of an explosive. The first firearms in the world were invented in 13th century China when the man portable fire lance was combined with projectiles such as scrap metal, broken porcelain, or darts/arrows. The technology gradually spread through the rest of East Asia, South Asia, Middle East and then into Europe. In older firearms, the propellant was typically black powder, but modern firearms use smokeless powder or other propellants. Most modern firearms have rifled barrels to impart spin to the projectile for improved flight stability.

Firearms have various safety mechanisms to prevent accidental discharge. These features, however, do not prevent unauthorized users from disengaging the safety mechanisms and using the firearms. Additionally, most safety features currently on the market can be turned 'off' if desired, so accidental use and misuse of guns by children, teens, and adults continue to be an unfortunate and devastating part of life in today's society. A safe solution is desirable.

Various attempts have been made to solve the above-mentioned problems such as those found in U.S. Pat. No. 5,603,179 to Adams; U.S. Pat. No. 6,874,265 to Pathak; and U.S. Pat. No. 8,104,313 to Wolfe. This art is representative of firearm safety devices. None of the above inventions and patents, taken either singly or in combination, is seen to describe the invention as claimed.

Ideally, a firearm safety device should provide safety, reasonable ease of use and, yet would operate reliably and be manufactured at a modest expense. Thus, a need exists for a reliable fingerprint recognition safety system to greatly reduce the occurrence of accidental weapons discharge and to avoid the above-mentioned problems.

BRIEF SUMMARY OF THE INVENTION

In view of the foregoing disadvantages inherent in the known firearm safety art, the present invention provides a novel fingerprint recognition safety system. The general purpose of the present invention, which will be described subsequently in greater detail is to provide a greatly increased safety system for firearms to reduce the possibility of accidental discharge.

A fingerprint recognition safety system is disclosed herein, in a preferred embodiment, comprising: a fingerprint recognition safety assembly for use with a firearm having an encoded circuit board with a CPU processor, a recognition software program, and a battery chip. The fingerprint recognition safety assembly further comprises a trigger sensor, a safety pin, a readiness indicator, and a charging port assembly having a charging cable, and a first and second connector in preferred embodiments. The fingerprint recognition safety assembly uses recognition technology, which is able to scan the firearm owner's fingerprint and unlock the safety pin, thereby allowing the firearm owner to utilize the firearm. Those with ordinary skill in the art will now appreciate that upon reading this specification and by their understanding the art of fingerprint scanning, recognition, information communication, verification, locking and unlocking means for pins as described herein, methods of authorization and use enabling and restriction will be understood by those knowledgeable in such art.

The fingerprint recognition safety assembly technology is universal (as designed), and is able to be retrofitted to an existing firearm. Alternately, the system may be manufactured OEM. The fingerprint recognition safety assembly comprises an encoded circuit board, a trigger sensor, a safety pin, a readiness indicator, and a charging port assembly in communicative cooperation, to digitally recognize the fingerprint of a firearm owner.

The encoded circuit board comprises a CPU processor, recognition software, and a battery chip in combination. The recognition software has memory capability for storing parameters (positive indicators) of the firearm owner's fingerprint, and prevents the firearm from discharging unless the fingerprint is recognized and authorized. The fingerprint recognition safety assembly protects from unintended use of a firearm in this way. The recognition software of the encoded circuit board allows the fingerprint recognition safety assembly to unlock the safety pin upon recognition of the fingerprint of the firearm owner. The encoded circuit board may have the firearm owner's private information from a concealed weapons permit to be verified to allow use of the firearm.

A battery chip powers the encoded circuit board, and in combination with the trigger sensor and charging port assembly, are completely embedded within the confines of the firearm and thus cannot be by-passed and alternately disabled without disassembling the firearm. The fingerprint recognition safety assembly renders the firearm un-usable if the fingerprint recognition safety assembly is tampered with, and then must be taken to a professional gunsmith, and the owner's private information verified to re-establish use of the firearm by resetting after tampering has occurred.

The trigger sensor may comprise light sensors in preferred embodiments for scanning the fingerprint of the firearm owner to prevent un-authorized use of the firearm. Upon recognition of the fingerprint of the firearm owner, the safety pin slides to an unlocked position to allow 'normal' use of the firearm. The readiness indicator allows the firearm owner to visually determine when the fingerprint recognition safety assembly is in a locked and unlocked condition, and uses LEDs to visually alert the firearm owner of readiness of the firearm.

The charging port assembly preferably comprises a charging cable with two connectors to allow charging of the battery chip on the encoded circuit board. The first connector is removably attached to the encoded circuit board, the second connector uses a USB-type connector to charge the battery chip of the encoded circuit board when the firearm is in a stored condition. The second connector of the charging cable is embedded within the grip of the firearm and is able to removably receive a charging apparatus for charging of the battery chip. The encoded circuit board allows the trigger sensor to recognize the fingerprint of the firearm owner and unlock the safety pin, thereby unlocking the trigger to allow the firearm owner to utilize the firearm.

The present invention holds significant improvements and serves as a fingerprint recognition safety system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, fingerprint recognition safety system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a firearm safety device and more particularly to a fingerprint recognition safety system as used to improve the general safety and use of firearms and reduce the possibility of accidental discharge.

Generally speaking, the fingerprint recognition safety system of the present invention provides firearm users with a safe and effective way to prevent unauthorized firearm use. This product may comprise fingerprint recognition technology built into a firearm's trigger. Inside the trigger is a chip, encoded with the firearm owner's individual information from their concealed weapons permit and their fingerprint. The chip can continuously scan the trigger for the encoded information while locking the firearm's safety in place. There is an indicator on the side of the firearm that readily shows when the firearm is locked and alternately when it is ready for firing. The encoded chip can be connected to a battery chip, which can be connected to a specially designed safety pin that locks the 'safety' in place. When recognition is made, the pin can release the safety, allowing the weapon to 'fire'. At the bottom of the firearm's grip can be a charging port. When stored on a gun rack or in a holster, a USB-type connection can be inserted into the port to charge the battery.

This technology is designed to be 'universal' and thus can be retrofitted for virtually any (modern) existing firearm, regardless of the make or model. The assembly, as designed, is also completely embedded inside the firearm, and cannot be 'turned off'. If an unauthorized user tampers with the technology, the firearm will 'lock up', requiring a person to take the firearm to a professional gunsmith, prove their identity, and show their ownership papers.

Figure 1:
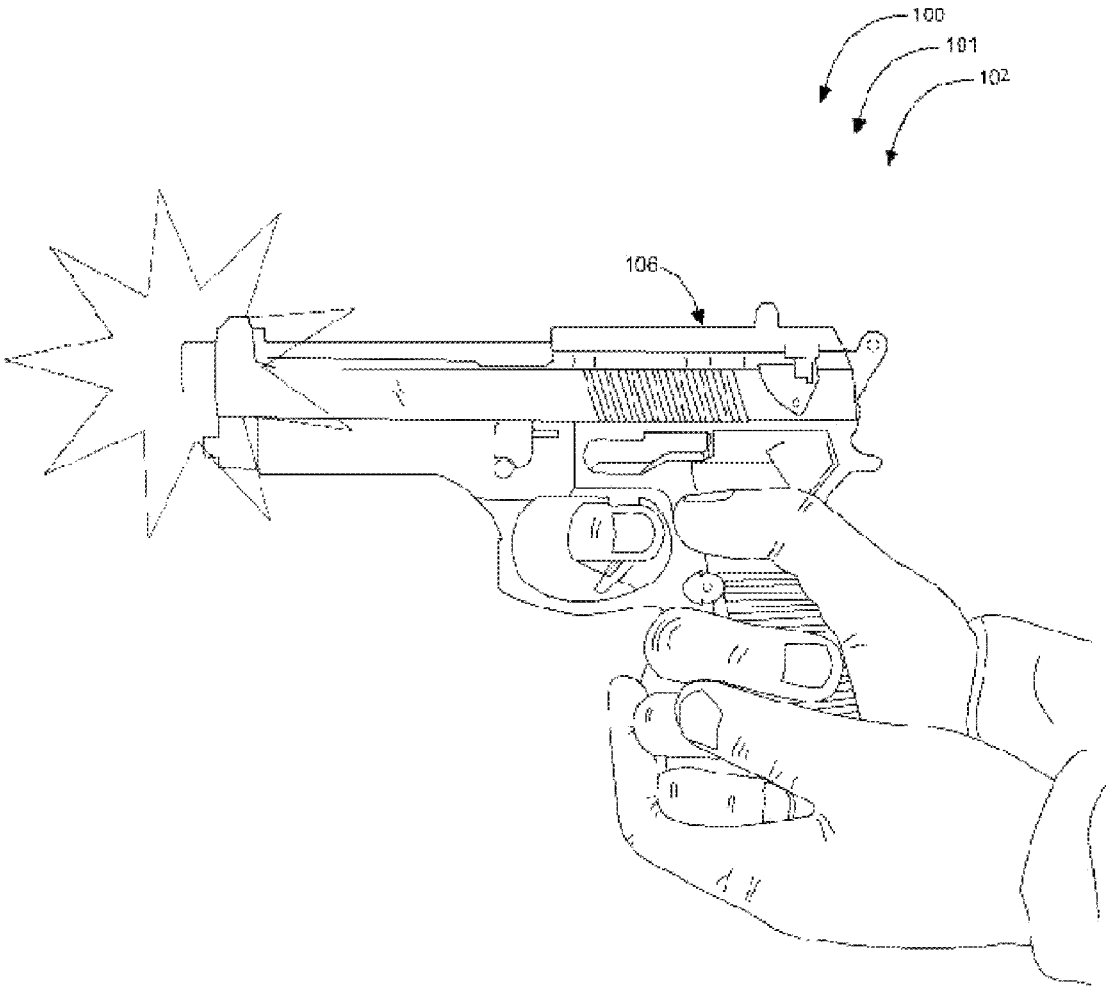
FIG. 1 shows a perspective view illustrating a fingerprint recognition safety system in an in-use condition according to an embodiment of the present invention.

Referring to the drawings by numerals of reference there is shown in FIG. 1, a perspective view illustrating an in-use condition 101 of fingerprint recognition safety system 100 according to an embodiment of the present invention.

Fingerprint recognition safety system 100 in a preferred embodiment comprises fingerprint recognition safety assembly 104 having encoded circuit board 110 with CPU processor 109, a fingerprint recognition software program, and battery chip 111. Fingerprint recognition safety assembly 104 further comprises trigger sensor 112, safety pin 114, readiness indicator 116, and charging port assembly 120 (having charging cable 122, first connector 124 and second connector 126). Fingerprint recognition safety assembly 104 uses fingerprint recognition technology, which is able to scan the firearm owners fingerprint and unlock safety pin 114, thereby allowing the firearm owner to utilize firearm 106.

Figure 2:
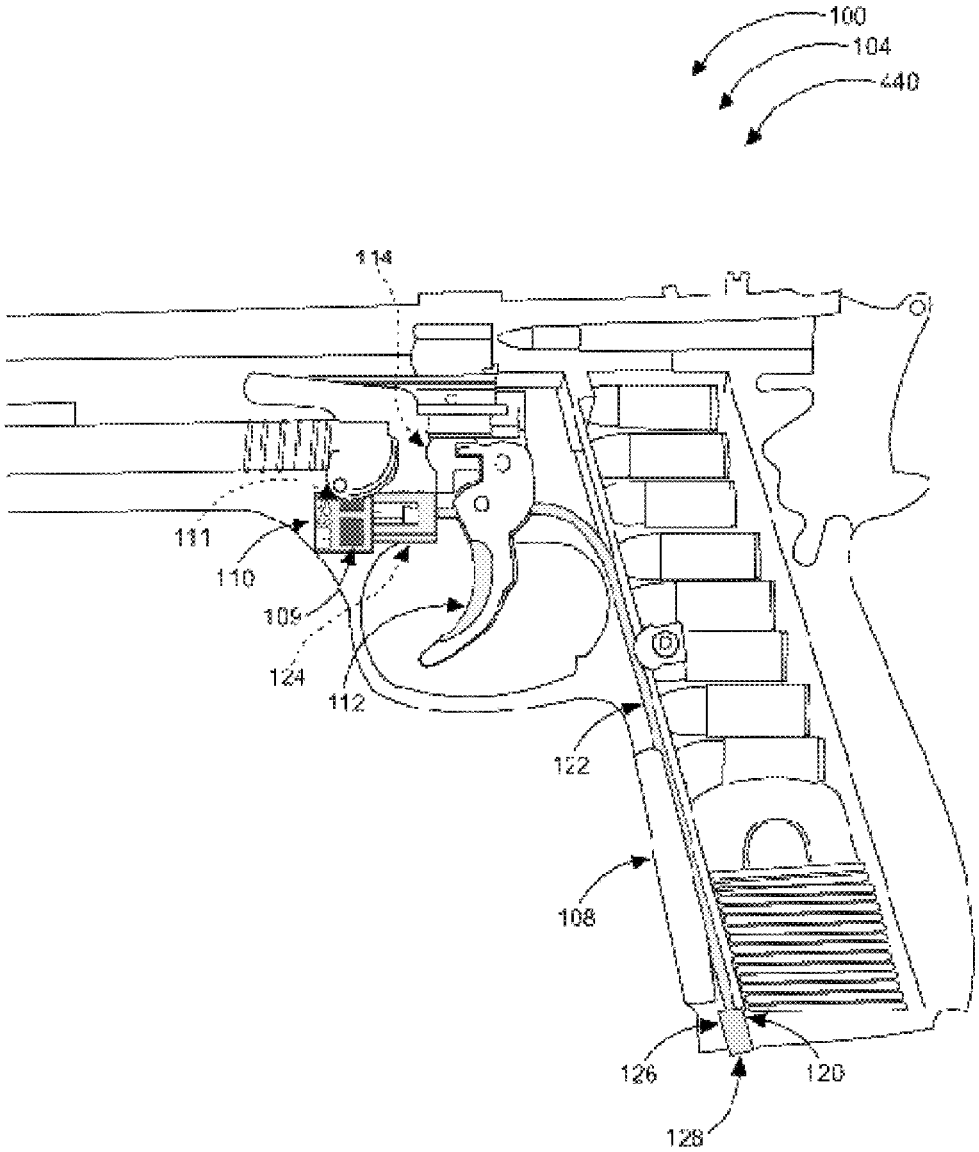
FIG. 2 is a cross section view illustrating a fingerprint recognition safety assembly of the fingerprint recognition safety system according to an embodiment of the present invention of FIG. 1.

Referring now to FIG. 2, a cross-section view illustrating fingerprint recognition safety assembly 104 of fingerprint recognition safety system 100 according to an embodiment of the present invention.

Fingerprint recognition safety assembly 104 technology is designed to be universal, as previously mentioned, and is able to be retrofitted to an existing firearm 106. Fingerprint recognition safety assembly 104 comprises encoded circuit board 110, trigger sensor 112, safety pin 114, readiness indicator 116, and charging port assembly 120 in communicative cooperation, the present invention able to digitally recognize the fingerprint of a firearm owner.

Encoded circuit board 110 comprises CPU processor 109, fingerprint recognition software and battery chip 111 in combination. The fingerprint recognition software has memory capability for storing parameters of the firearm owner's fingerprint, and prevents firearm 106 from discharging unless the fingerprint is recognized and authorized. Fingerprint recognition safety assembly 104 protects from unintended use of firearm 106. The fingerprint recognition software of encoded circuit board 110 allows fingerprint recognition safety assembly 104 to unlock safety pin 114 upon recognition of the fingerprint of the firearm owner. Encoded circuit board 110 has the firearm owner's private information from a concealed weapons permit to allow use of firearm 106.

Figure 3:
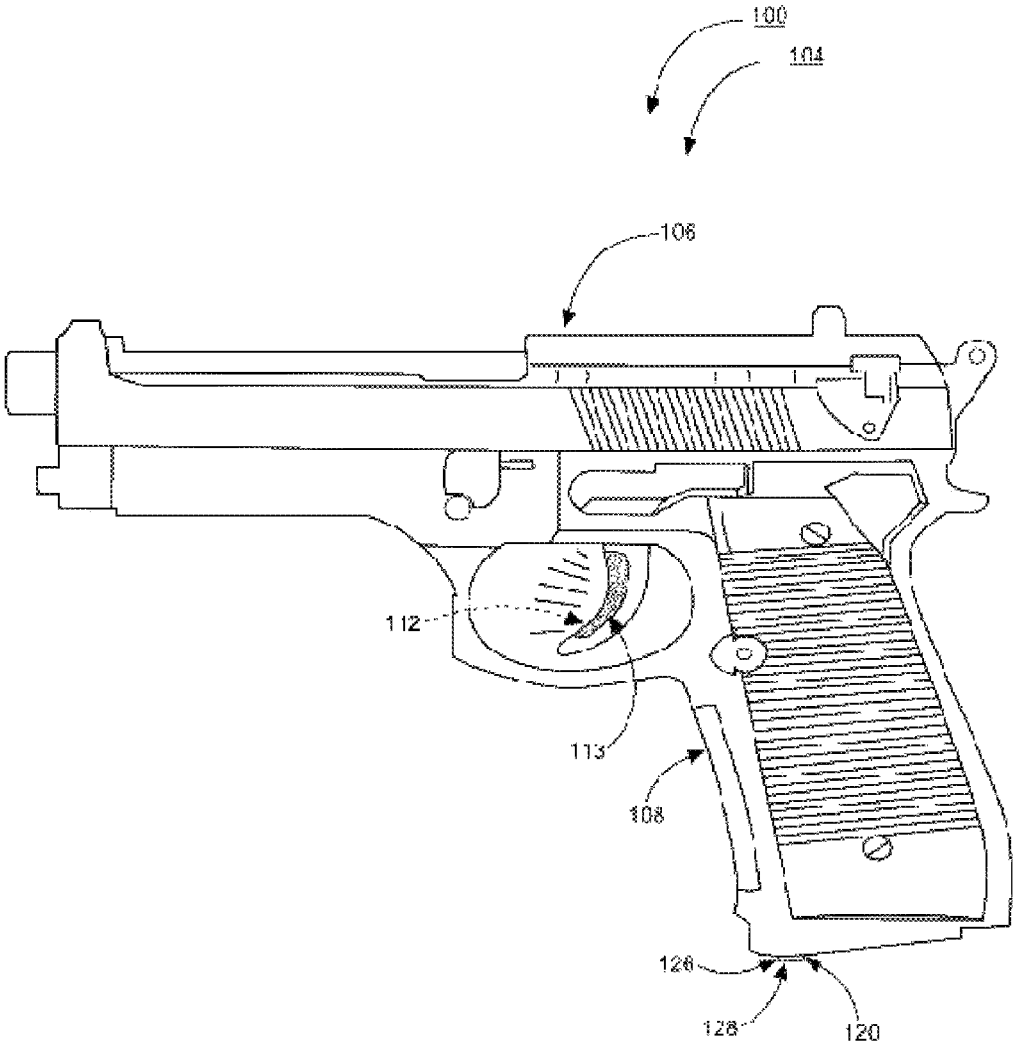
FIG. 3 is a perspective view illustrating the fingerprint recognition safety assembly according to an embodiment of the present invention of FIG. 1.

Referring now to FIG. 3, a perspective view illustrating fingerprint recognition safety assembly 104 according to an embodiment of the present invention.

Battery chip 111 powers encoded circuit board 110, and in combination with trigger sensor 112 and charging port assembly 120, are completely embedded within the confines of firearm 106 and cannot be by-passed and alternately disabled without disassembling firearm 106. Fingerprint recognition safety assembly 104 renders firearm 106 un-usable if fingerprint recognition safety assembly 104 is tampered with. Firearm 106 then must be taken to a professional gunsmith, and the firearm owner's private information be verified to re-establish use of firearm 106 by 'resetting' after tampering has occurred.

Trigger sensor 112 preferably comprises light sensors 113 for scanning the fingerprint of the firearm owner to prevent un-authorized use of firearm 106. Other suitably equivalent fingerprint recognition means may be used. Upon recognition of the fingerprint of the firearm owner, safety pin 114 slides to an unlocked condition to allow use of firearm 106.

Figure 4:
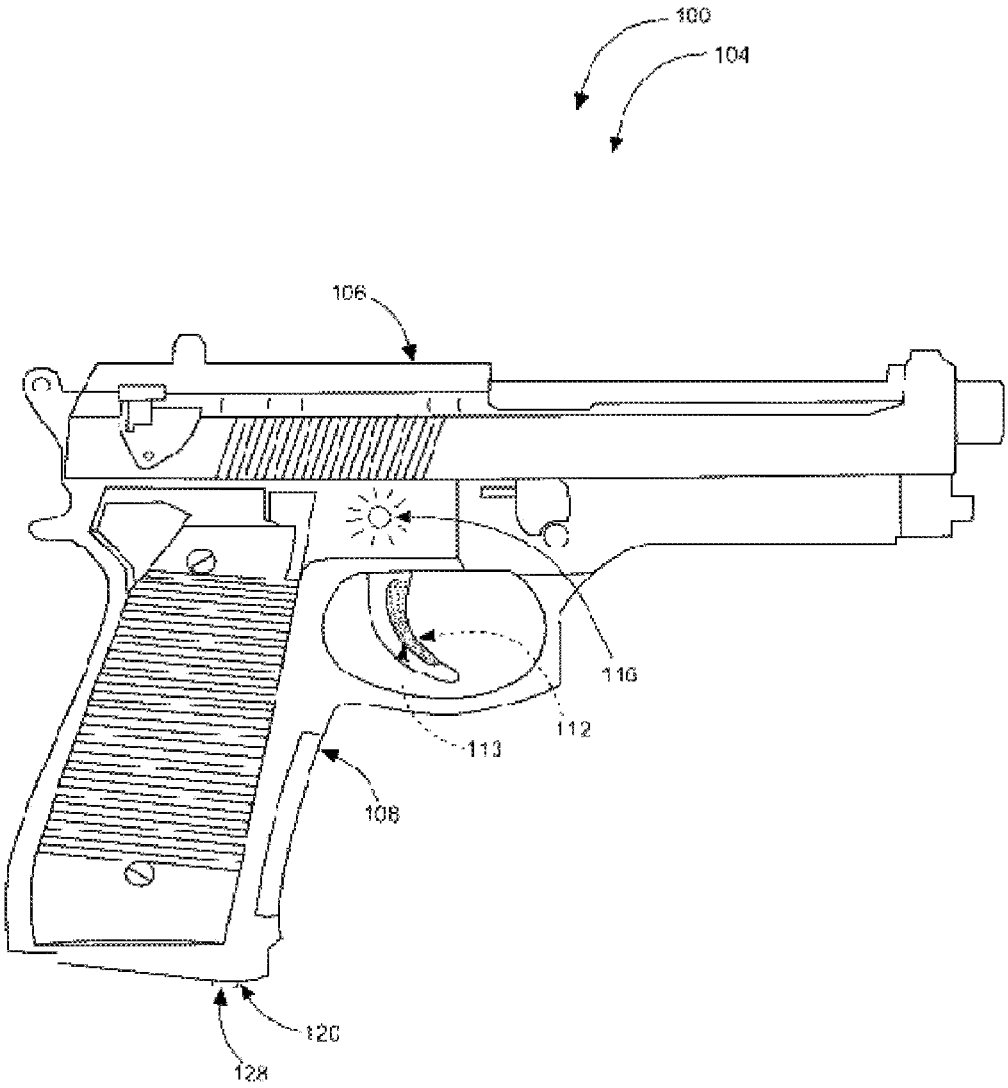
FIG. 4 is another perspective view illustrating the fingerprint recognition safety assembly according to an embodiment of the present invention of FIG. 1.

Referring now to FIG. 4, showing a side view illustrating firearm 106 using fingerprint recognition safety assembly 104 according to an embodiment of the present invention.

Readiness indicator 116 allows the firearm owner to visually (and readily) determine when fingerprint recognition safety assembly 104 is in a locked or an unlocked condition, and uses LEDs to visually alert the firearm owner of readiness of firearm 106.

Charging port assembly 120 comprises charging cable 122 with first connector 124 and second connector 126 to allow charging of battery chip 111 on encoded circuit board 110. First connector 124 is removably attached to encoded circuit board 110, second connector 126 uses a USB-type connector 128 to charge battery chip 111 of encoded circuit board 110 when firearm 106 is in a stored condition. Second connector 126 of charging cable 122 is embedded within grip 108 of firearm 106 and is able to removably receive a charging apparatus for charging of battery chip 111.

Encoded circuit board 110 allows trigger sensor 112 to recognize the fingerprint of the firearm owner and unlock safety pin 114, thereby unlocking the trigger to allow the firearm owner to utilize firearm 106.

Fingerprint recognition safety system 100 may be sold as kit 440 comprising the following parts: at least one encoded circuit board 110 at least one trigger sensor 112; at least one safety pin 114; at least one readiness indicator 116; at least one charging port assembly 120; and at least one set of user instructions. Fingerprint recognition safety system 100 may be manufactured and provided for sale in a wide variety of sizes and shapes for a wide assortment of firearm applications (which may be retro-fit or OEM). Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
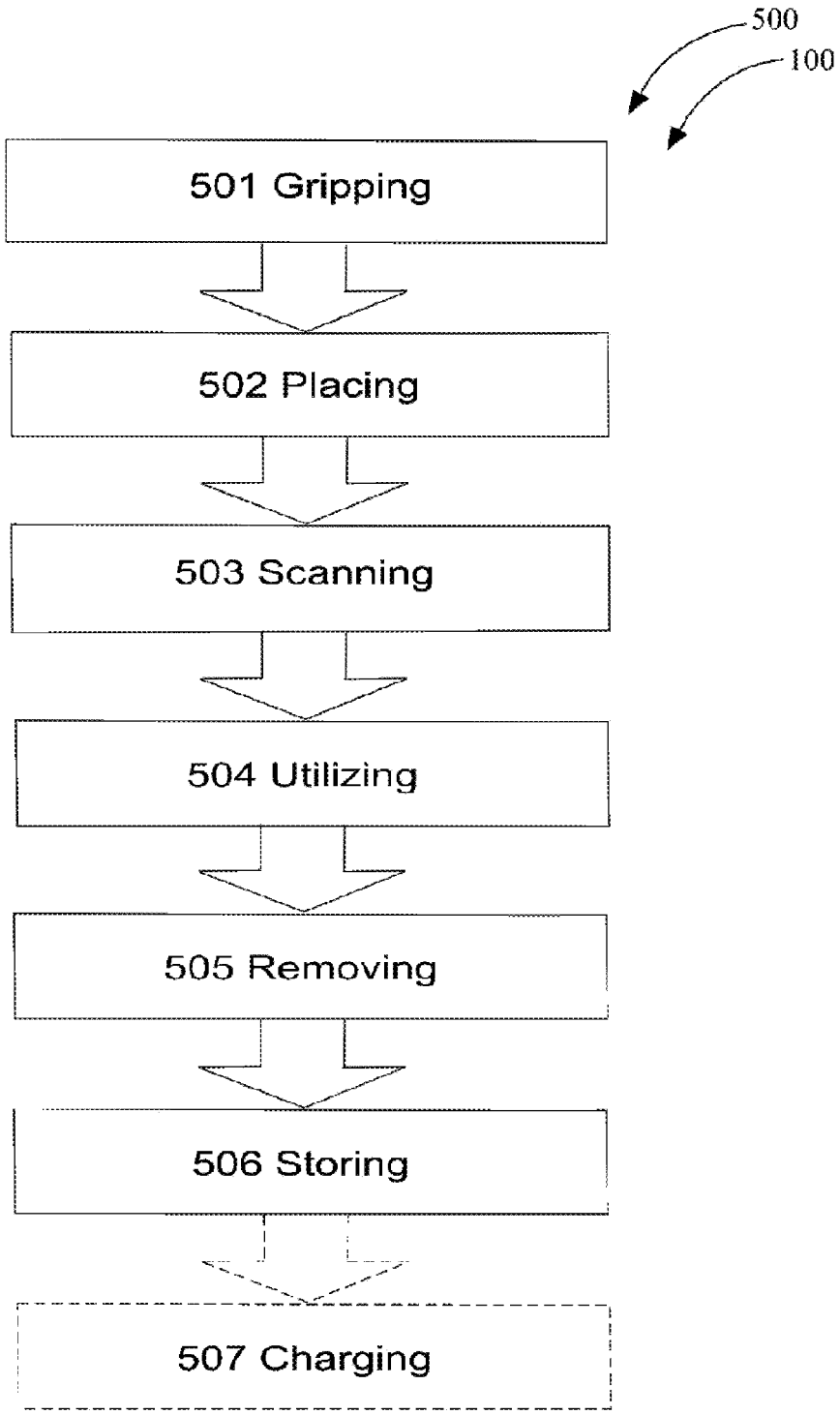
FIG. 5 is a flowchart illustrating a method of use for the fingerprint recognition safety system according to an embodiment of the present invention of FIGS. 1-4.

Referring now to FIG. 5, showing a flowchart illustrating a method of use 500 for fingerprint recognition safety system 100 according to an embodiment of the present invention of FIGS. 1-4.

A method of use 500 preferably comprises step one 501 gripping a firearm, step two 502 placing index finger on trigger sensor, step three 503 scanning fingerprint, step four 504 utilizing firearm, step five 505 removing index finger from trigger sensor, step six 506 storing firearm. The method may further comprise step seven 507 charging the battery chip (as needed).

It should be noted that step 507 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A fingerprint recognition safety system comprising:

a) a fingerprint recognition safety assembly having;
  i) an encoded circuit board having;
    (1) a CPU processor;
    (2) a recognition software program; and
    (3) a battery chip;
  ii) a trigger sensor;
  iii) a safety pin;
  iv) a readiness indicator; and
  v) a charging port assembly having;
    (1) a charging cable;
    (2) a first connector; and
    (3) a second connector;

b) wherein said fingerprint recognition safety system comprises said fingerprint recognition safety assembly;

c) wherein said fingerprint recognition safety assembly comprises said encoded circuit board, said trigger sensor, said safety pin, said readiness indicator, and said charging port assembly is structured and arranged in communicative cooperation to digitally recognize a fingerprint of an authorized firearm owner;

d) wherein said encoded circuit board comprises said CPU processor, said recognition software and said battery chip in combination;

e) wherein said recognition software of said encoded circuit board is structured and arranged with said safety pin to only allows said fingerprint recognition safety assembly to unlock said safety pin upon recognition of said fingerprint of said authorized firearm owner;

f) wherein said battery chip of said encoded circuit board is structured and arranged to power said fingerprint recognition safety assembly;

g) wherein said encoded circuit board is confined within said firearm housing and is structured and arranged with said safety pin to prevent tampering with said fingerprint recognition safety assembly;

h) wherein said trigger sensor is structured and arranged to prevent use of said firearm except when said trigger sensor scans said fingerprint of an authorized user;

i) wherein said trigger sensor is embedded within said trigger and is structured and arranged with said safety pin to prevent tampering with said fingerprint recognition safety assembly;

j) wherein said safety pin is structured and arranged with said trigger sensor to only slide to an unlocked position to allow use of said firearm only upon recognition of said fingerprint of said authorized firearm owner;

k) wherein said readiness indicator is structured and arranged to allow said authorized firearm owner to visually determine when said fingerprint recognition safety assembly is in a locked condition and when in said unlocked condition;

l) wherein said charging port assembly comprises said charging cable with said first connector and said second connector and is structured and arranged to allow charging of said battery chip of said encoded circuit board;

m) wherein said first connector of said charging cable is removably attached to said encoded circuit board;

n) wherein said second connector of said charging cable is embedded within a grip of said firearm and is structured and arranged to removably receive a charging apparatus for charging of said battery chip of said encoded circuit board ready for use; and wherein said encoded circuit board is structured and arranged to allow said trigger sensor to recognize said fingerprint of said authorized firearm owner and unlock said safety pin, thereby unlocking said trigger to allow said authorized firearm owner to utilize said firearm;

o) wherein when said fingerprint recognition safety system is installed in its entirety and tampered with, said firearm is structured and arranged such that said firearm must be taken to a professional gunsmith and said authorized owner's private information be verified to reestablish use of said firearm by resetting after tampering has occurred.

2. The fingerprint recognition safety system of claim 1 wherein said fingerprint recognition safety assembly is structured and arranged to uses recognition technology, and is further structured and arranged to scan said authorized firearm owner's fingerprint and unlock said safety pin, thereby allowing said authorized firearm owner to utilize said firearm.

3. The fingerprint recognition safety system of claim 2 wherein when said fingerprint recognition safety system of claim 1 is installed in its entirety, said fingerprint recognition safety assembly is structured and arranged to prevents said firearm from discharging unless said fingerprint is recognized and authorized.

4. The fingerprint recognition safety system of claim 3 wherein said fingerprint recognition safety assembly is structured and arranged to protects from unintended use of said firearm.

5. The fingerprint recognition safety system of claim 4 wherein said encoded circuit board is structured and arranged with private information of said authorized firearm owner comprising a concealed weapons permit that is further is structured and arranged to enable use of said firearm by said authorized firearm owner when verified.

6. The fingerprint recognition safety system of claim 5 wherein said fingerprint recognition safety assembly is completely embedded within confines of said firearm and is structured and arranged such that said fingerprint recognition safety assembly cannot be by-passed and alternately disabled without disassembling said firearm.

7. The fingerprint recognition safety system of claim 6 wherein said fingerprint recognition safety assembly is structured and arranged to render said firearm un-usable if said fingerprint recognition safety assembly is tampered with.

8. The fingerprint recognition safety system of claim 7 wherein when said fingerprint recognition safety system of claim 11 is installed in its entirety and tampered with, said firearm is structured and arranged such that said firearm must be taken to a professional gunsmith and said authorized owner's private information be verified to reestablish use of said firearm by resetting after tampering has occurred.

9. The fingerprint recognition safety system of claim 2 wherein said fingerprint recognition safety assembly technology is structured and arranged to be retrofitted to at least one existing said firearm.

10. The fingerprint recognition safety system of claim 2 wherein said trigger sensor comprises a scanning mechanism which is structured and arranged to sends input to said CPU processor for processing.

11. The fingerprint recognition safety system of claim 10 wherein said recognition software comprises memory capability structured and arranged for storing parameters of said fingerprint.

12. The fingerprint recognition safety system of claim 10 wherein said trigger sensor comprises light sensors structured and arranged for scanning said fingerprint of said authorized firearm owner.

13. The fingerprint recognition safety system of claim 1 wherein said readiness indicator comprises LEDs structured and arranged to visually alert said authorized firearm owner of readiness of said firearm.

14. The fingerprint recognition safety system of claim 1 wherein said second connector of said charging cable comprises a USB-type connector is structured and arranged to charge said battery chip of said encoded circuit board.

15. The fingerprint recognition safety system of claim 14 wherein said battery chip of said encoded circuit board is structured and arranged to be charged when said firearm is in a stored condition.

16. The fingerprint recognition safety system of claim 1 wherein said trigger sensor comprises a pressure sensors structured and arranged for recognition of said fingerprint of said authorized firearm owner.

17. A fingerprint recognition safety system comprising:

a) a fingerprint recognition safety assembly having;

i) an encoded circuit board having;

(1) a CPU processor;

(2) a fingerprint recognition software program; and (3) a battery chip;

ii) a trigger sensor;

iii) a safety pin;

iv) a readiness indicator; and v) a charging port assembly having;

(1) a charging cable;

(2) a first connector; and (3) a second connector;

b) wherein said fingerprint recognition safety system comprises said fingerprint recognition safety assembly;

c) wherein said fingerprint recognition safety assembly uses fingerprint recognition software, which is able to scan said fingerprint of an authorized firearm owner and unlock said safety pin, thereby allowing said authorized firearm owner to utilize a firearm;

d) wherein said fingerprint recognition safety assembly technology is designed as universal and is able to be retrofitted to at least one existing said firearm;

e) wherein said fingerprint recognition safety assembly comprises said encoded circuit board, said trigger sensor, said safety pin, said readiness indicator, and said charging port assembly is structured and arranged in communicative cooperation to digitally recognize said fingerprint of said authorized firearm owner;

f) wherein said encoded circuit board comprises said CPU processor, said fingerprint recognition software, and said battery chip in combination;

g) wherein said recognition software comprises memory capability for storing distinguishing parameters of said fingerprint;

h) wherein said fingerprint recognition safety assembly prevents said firearm from discharging unless said fingerprint is recognized and authorized;

i) wherein said fingerprint recognition safety assembly protects from unintended use of said firearm;

j) wherein said fingerprint recognition software of said encoded circuit board is structured and arranged with said safety pin to only allows said fingerprint recognition safety assembly to unlock said safety pin upon recognition of said fingerprint of said authorized firearm owner;

k) wherein said encoded circuit board has said authorized firearm owner's private information from a concealed weapons permit to allow use of said firearm;

l) wherein said battery chip of said encoded circuit board is structured and arranged to power said fingerprint recognition safety assembly;

m) wherein said encoded circuit board is confined within a firearm housing and is structured and arranged with said safety pin to prevent tampering with said fingerprint recognition safety assembly;

n) wherein said fingerprint recognition safety assembly is effectively embedded within confines of said firearm and cannot be disabled without disassembling said firearm;

o) wherein said fingerprint recognition safety assembly will render said firearm un-usable if said fingerprint recognition safety assembly is tampered with;

p) wherein said firearm must be taken to a professional gunsmith and private information from said authorized firearm owner be verified to re-establish use of said firearm by resetting after tampering has occurred;

q) wherein said trigger sensor comprises light sensors for scanning said fingerprint of said authorized firearm owner;

r) wherein said is structured and arranged to prevent use of said firearm except when said trigger sensor scans said fingerprint of an authorized user;

s) wherein said user must be said authorized firearm owner to use said firearm;

t) wherein said trigger sensor is embedded within said trigger and is structured and arranged with said safety pin to prevent tampering with said fingerprint recognition safety assembly;

u) wherein said safety pin is structured and arranged with said trigger sensor to only slide to an unlocked position to allow use of said firearm only upon recognition of said fingerprint of said authorized firearm owner;

v) wherein said readiness indicator uses LEDs to visually alert said authorized firearm owner of readiness condition of said firearm;

w) wherein said readiness indicator is structured and arranged to allow said authorized firearm owner to visually determine when said fingerprint recognition safety assembly is in a locked condition and when in said unlocked condition;

x) wherein said charging port assembly comprises said charging cable with said first connector and said second connector is structured and arranged to allow charging of said battery chip of said encoded circuit board;

y) wherein said first connector of said charging cable is removably attached to said encoded circuit board;

z) wherein said second connector of said charging cable uses a USB-type connector to charge said battery chip of said encoded circuit board when connected to a power source;

aa) wherein said battery chip of said encoded circuit board is able to be charged when said firearm is in a stored condition;

bb) wherein said second connector of said charging cable is embedded within a grip of said firearm and is structured and arranged to removably receive a charging apparatus for charging of said battery chip of said encoded circuit board ready for use; and cc) wherein said encoded circuit board allows said trigger sensor to recognize said fingerprint of said authorized firearm owner and unlock said safety pin, thereby unlocking said trigger to allow said authorized firearm owner to utilize said firearm.

18. The fingerprint recognition safety system of claim 17 further comprising a kit including: one said encoded circuit board, one said trigger sensor, one said safety pin, one said readiness indicator, one said charging port assembly, and one set of user instructions for use.

19. A method of using the fingerprint recognition safety system of claim 17 comprising the steps of:

a) gripping a firearm, b) placing an index finger against a trigger sensor, c) scanning a fingerprint from said index finger, d) utilizing said firearm by firing, e) removing said index finger from said trigger sensor, and f) storing said firearm.

20. The method of claim 19 may further comprise the step of: charging said battery chip as needed.

* * * * *